US010240796B1

(12) United States Patent
Stilwell et al.

(10) Patent No.: US 10,240,796 B1
(45) Date of Patent: Mar. 26, 2019

(54) FIRE PIT INSERT ASSEMBLY

(71) Applicant: Beckwell Companies, LLC, Oklahoma City, OK (US)

(72) Inventors: Brandon Stilwell, Oklahoma City, OK (US); Rebecca Stilwell, Oklahoma City, OK (US); Rodney Dean Brakhage, Stillwater, OK (US)

(73) Assignee: Beckwell Companies, LLC, Oklahoma City, OK (US)

( * ) Notice: Subject to any disclaimer, the term of this patent is extended or adjusted under 35 U.S.C. 154(b) by 0 days.

(21) Appl. No.: 15/836,575

(22) Filed: Dec. 8, 2017

Related U.S. Application Data

(63) Continuation of application No. 15/666,291, filed on Aug. 1, 2017, which is a continuation of application No. 15/600,323, filed on May 19, 2017.

(60) Provisional application No. 62/339,532, filed on May 20, 2016.

(51) Int. Cl.
*F24B 1/191* (2006.01)
*F23N 5/26* (2006.01)

(52) U.S. Cl.
CPC ..... *F24B 1/191* (2013.01); *F23N 5/265* (2013.01); *F23N 2900/00* (2013.01)

(58) Field of Classification Search
CPC ..... F23D 11/34; F23D 11/345; F23D 14/84; F23N 5/265; F23N 2005/165; F23N 2900/00; F24B 1/191
See application file for complete search history.

(56) References Cited

U.S. PATENT DOCUMENTS

| | | | | |
|---|---|---|---|---|
| 2,210,477 | A * | 8/1940 | Benecke et al. | H04R 1/345 181/150 |
| 3,642,091 | A * | 2/1972 | Nohara | H04R 1/028 181/150 |
| 6,896,512 | B2 * | 5/2005 | Rattner | F23D 14/16 126/91 R |
| 2004/0060554 | A1 * | 4/2004 | Schlosser | F24B 1/1808 126/512 |
| 2006/0003276 | A1 * | 1/2006 | Bachinski | F24B 1/1808 431/125 |
| 2011/0294079 | A1 * | 12/2011 | McBride | F23C 99/003 431/126 |

OTHER PUBLICATIONS

ExperiencingPhysics, "Visualizing Sound Through Fire in 3D", Mar. 12, 2013, http://www.instructables.com/id/Visualizing-Sound-Through-Fire-in-3D/.*

* cited by examiner

*Primary Examiner* — Steven B McAllister
*Assistant Examiner* — Steven Anderson, II
(74) *Attorney, Agent, or Firm* — Gable Gotwals

(57) ABSTRACT

Embodiments of a fire pit insert include a mixing tube with a fuel outlet end, a soundwave input end located below and horizontally offset from the fuel outlet end, and a fuel inlet located between the fuel outlet end and the soundwave input end. A fuel distribution chamber connected to the fuel outlet end has a top plate with orifices, a bottom plate spaced apart from the top plate, and a baffle located between the top and bottom plates. The baffle is arranged coaxial to the fuel outlet end.

20 Claims, 9 Drawing Sheets

FIRE PIT INSERT ASSEMBLY

CROSS-REFERENCE TO PENDING APPLICATIONS

This application claims priority to U.S. Ser. No. 15/600,323, filed May 19, 2017, which in turn claimed priority to U.S. 62/339,532 filed May 20, 2016.

BACKGROUND

This disclosure relates to outdoor or backyard fire pits and more particularly to fire pit inserts.

An open fire creates an inviting, relaxing atmosphere. People will often pass long hours just staring into the flickering flames and talking to friends. Such fires were once strictly limited to campsites and campgrounds but are now finding increased usage in backyards and on patios due to the prevalence of fire pits, which have become desirable additions to outdoor spaces. Fire pits are available in a wide variety of shapes and sizes and can be used with fire wood and also with gaseous fuels, such as propane and natural gas. Even with such a wide variety of options, the flame generated by one fire pit is generally similar in appearance to the flame of another fire pit.

Fire is often used decoratively in fireplaces and in theatrical fire effects for its unique and powerful sensory impact. In theatrical effects, bursts of fire are sometimes triggered in conjunction with music. To date, such theatrical fire effects have required the use of a pre-recorded sequence of timed triggers. This greatly reduces the cost and randomness of the visual effects that a flame display can generate.

Accordingly, a need exists for a fire pit insert assembly that can mix sound waves and fuel to randomly modulate a flame. It is to such a fire pit insert assembly that the inventive concepts disclosed herein are directed.

SUMMARY

Embodiments of a fire pit insert include a mixing tube that has a first (fuel outlet) end, a second (soundwave input) end located below and horizontally offset from the first end, and a fuel inlet located between the first and second ends. A fuel distribution chamber is connected to the first end.

The fuel distribution chamber may include a top plate with a plurality of orifices, a bottom plate spaced apart from the top plate, and a baffle located between the top and bottom plates, with the baffle arranged coaxial to the fuel outlet end. In some embodiments, the baffle includes a planar plate with at least one concave-shaped side.

A housing or surround may contain the mixing tube and fuel distribution chamber. At least one soundwave source can be connected to the second end and contained within the housing. In some embodiments, the first end of the mixing tube is located above and arranged coaxial to a lowermost end of the mixing tube. The second end of the tube is located above the lowermost end of the mixing tube. The mixing tube may be square-shaped and include at least one bend between the first and second ends, and this bend can be the lowermost end or bottom of the mixing tube

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

Figure 1:
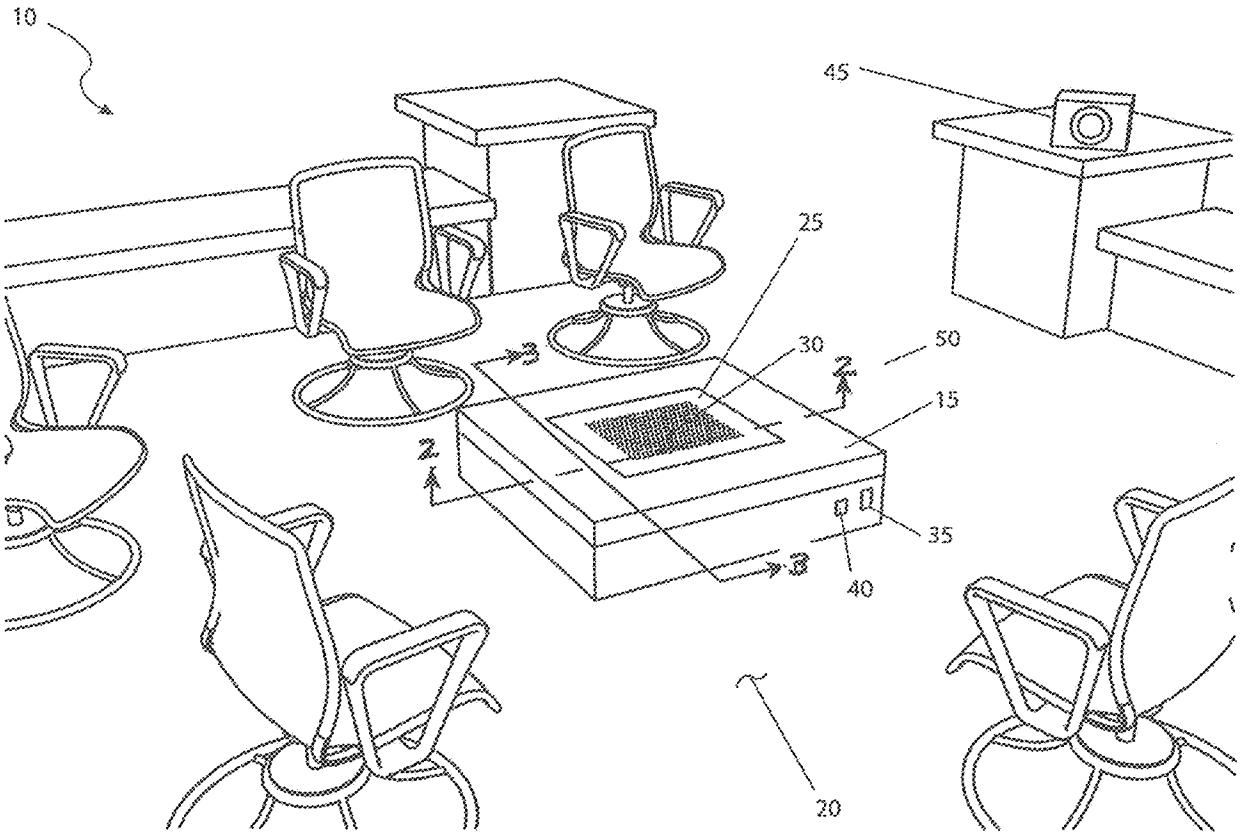
FIG. 1 is a perspective view of a fire pit insert assembly constructed in accordance with the inventive concepts disclosed herein shown in a utilized state in a fire pit.

Elements and Numbering Used in the Drawings and Detailed Description

10 fire pit insert with music interface ("device")
15 fire pit insert assembly
20 patio setting
25 top surface
30 perforations
35 electrical cutoff switch
40 fuel cutoff valve
45 audio source
50 wireless audio signal
55 lower enclosure box
60 supporting brace
65 adjacent sides
70 circular mounting flange tube(s)
75 speakers
82 wireless receiver
84 audio power amplifier
95 inlet ports
90 header system
92 fuel source
100 fire pit insert assembly
102 housing
104 top plate
105 sidewalls
106 bottom plate
107 lip
108 mixing tube
110 first speaker
111 second speaker
112 central opening
114 mounting plate
115 communication center
117 mounting plate
119 gas distribution space
120 orifices
124 gasket
125 upper member
130 lower member
131 first (fuel outlet) end
132 second (soundwave inlet) end

136 fuel inlet
139 low level signal wire
140 baffle plate
141 concave side
143 bend
144 lowermost or bottom end
145 AC power wiring
147 uppermost or top end
150 AC power source

DETAILED DESCRIPTION

Before explaining at least one embodiment disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or 8 is satisfied by anyone of the following: A is true (or present) and 8 is false (or not present), A is false (or not present) and 8 is true (or present), and both A and 8 are true (or present).

In addition, use of the word "a" or "an" are employed to describe elements and components of the embodiments disclosed herein. This is done merely for convenience and to give a general sense of the inventive concepts. This description should be read to include one or at least one, and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
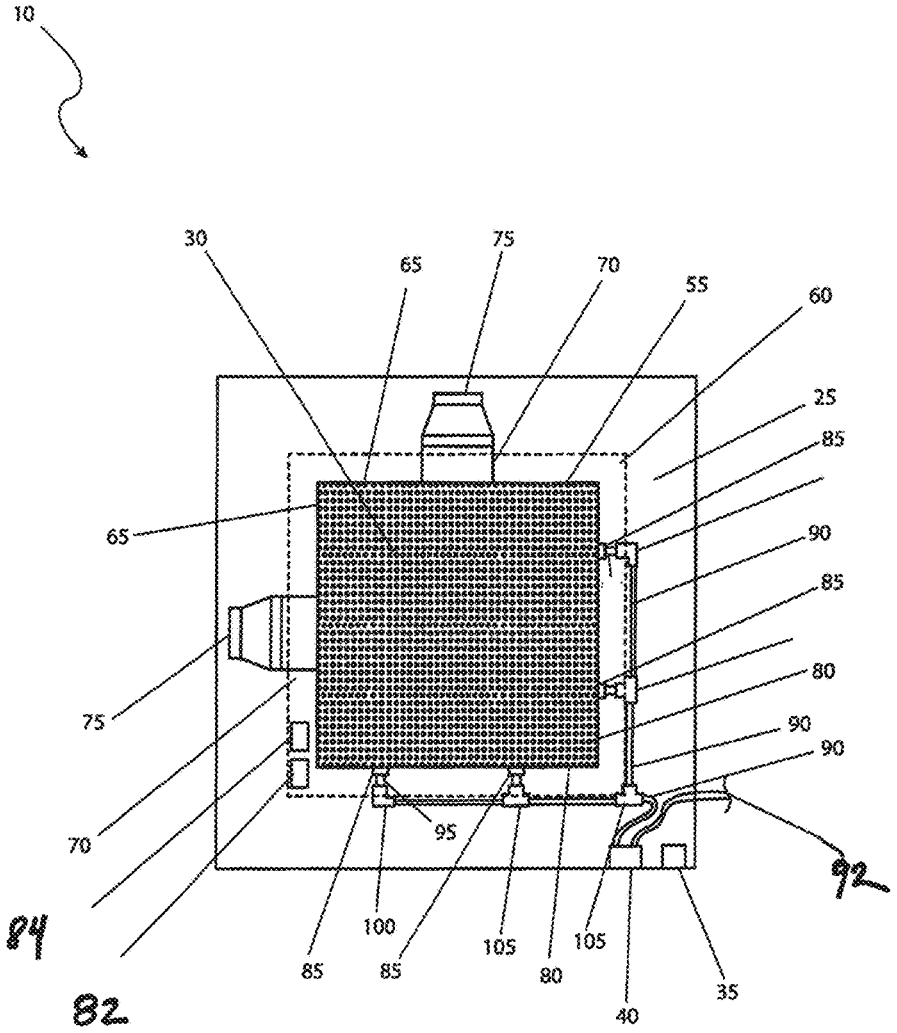
FIG. 2 is a sectional view of the fire pit insert assembly taken along line 2-2 of FIG. 1.

Referring now to the drawings, and in particular FIGS. 1 and 2, a perspective view of the patio gas fire pit insert with music interface 10 shown in a utilized state in a fire pit insert assembly 15. The patio gas fire pit insert with music interface 10 (herein described as the "device") 10, is set in a fire pit 15 as would be used in a patio setting 20. The device 10 is provided with a top surface 25, envisioned to be manufactured of stainless steel, and is provided with a plurality of perforations 30 upon which flames are emitted. The device 10 is provided with concealed electrical hookups which will be described in greater detail herein below. A gas supply connection is also provided to serve as a fuel source for the device 10. The gas supply may be provided by natural gas or propane, although other fuel sources could be utilized, and as such, the use of a specific fuel source should not be interpreted as a limiting factor of the inventive concepts disclosed herein. The device 10 is provided with an electrical cutoff switch 35 and a fuel cutoff valve 40 on the exterior of the fire pit 15. The electrical cutoff switch 35 and the fuel cutoff valve 40 will be described in greater detail herein below.

An audio source 45, such as a portable music player, a smart phone, a tablet computer, a karaoke machine, or the like is also utilized with the device 10. The audio source 45 provides a wireless audio signal 50 to the device 10. The wireless audio signal 50 is envisioned as a radio frequency signal such as Bluetooth® signal, although other types of radio frequencies such as Wi-Fi, infrared signals, proprietary radio frequency signals, and the like could be used with equal effectiveness. The audio source 45 would typically be located nearby within the patio setting 20 such that it could be controlled with regards to musical content, volume, playback, and the like. The overall size of the area of perforations 30 is envisioned to be approximately twenty (20) inches by twenty (20) inches in a generally square configuration. However, other shapes and sizes could also be utilized. An alternate embodiment of usage includes use of the top surface 25 as a cooking surface.

Referring now to FIG. 2, the top surface 25 is shown with a lower enclosure box 55 in a centered position bordered by a supporting brace 60. Two adjacent sides 65 are provided with circular mounting flange tube(s) 70 in a centered position. The circular mounting flange tube(s) 70 are envisioned to be made of heat resistant stainless steel. A pair of speakers 75 is mounted such that they project inward. The opposite adjacent sides 80 of the lower enclosure box 55 are provided with a set of four (4) inlet ports 85 (two per side) in an equally spaced manner. These inlet ports 85 are connected to a common header system 90 consisting of couplings, elbows, and tees. The header system 90 is routed to the fuel cutoff valve 40 and ultimately to a fuel source 92, such as a propane tank or natural gas line.

A wireless receiver 82 and an audio power amplifier 84 are located adjacent to at least one of the speakers 75. Further details on the interconnections between the wireless receiver 82 and the audio power amplifier 84 with the speakers 75 and the electrical cutoff switch 35 will be provided herein below. The sound waves produced by the speakers 75 such as music or voice, produces nodes and anti-nodes on the interior of the lower enclosure box 55. The nodes and anti-nodes move the flammable gas as it is emitted from the perforations 30 in the top surface 25 producing the effect of resultant flames on the topside of the fire pit 15 (as shown in FIG. 1) to move or "dance" according to the frequency of the waves (consisting of the nodes and anti-nodes) produced by the speakers 75.

Figure 3:
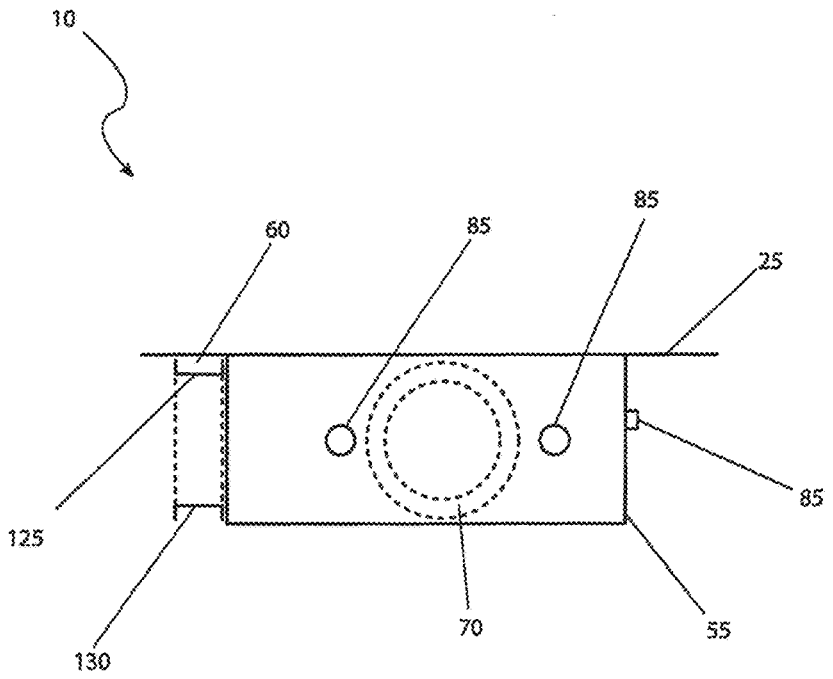
FIG. 3 is a sectional view of the fire pit insert assembly taken along line 3-3 of FIG. 1.

Referring now to FIG. 3, this view provides observation of three (3) of the four (4) inlet ports 85 while one (1) of the two (2) circular mounting flange tube(s) 70 is visible by a hidden line. The supporting brace 60 consists of an upper member 125 and lower member 130, envisioned to be manufactured from carbon steel. The supporting brace 60 is routed on all four (4) sides of top surface 25 and is only depicted on one (1) side of the top surface 25 in FIG. 3 for purposes of illustrative clarity.

The device 10 can be inserted into a wide variety of fire pit 15 (as shown in FIG. 1) such as those constructed by paving stones, cast in concrete, made of stucco, or even manufactured from steel. Support of the device 10 within the fire pit 15 (as shown in FIG. 1) would be accommodated by the top surface 25 as resting upon the supporting brace 60. Such an arrangement provides future access to the components of the device 10 for future maintenance or repair.

Figure 4:
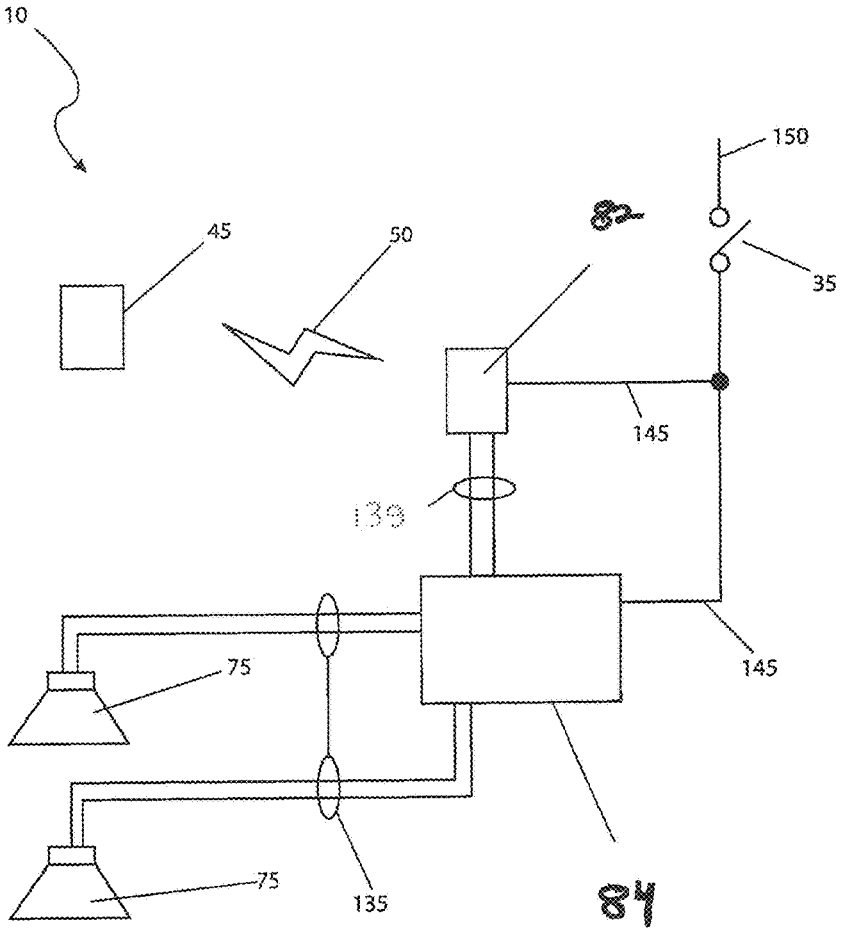
FIG. 4 is an electrical block diagram of the fire pit insert assembly.
Figure 5:
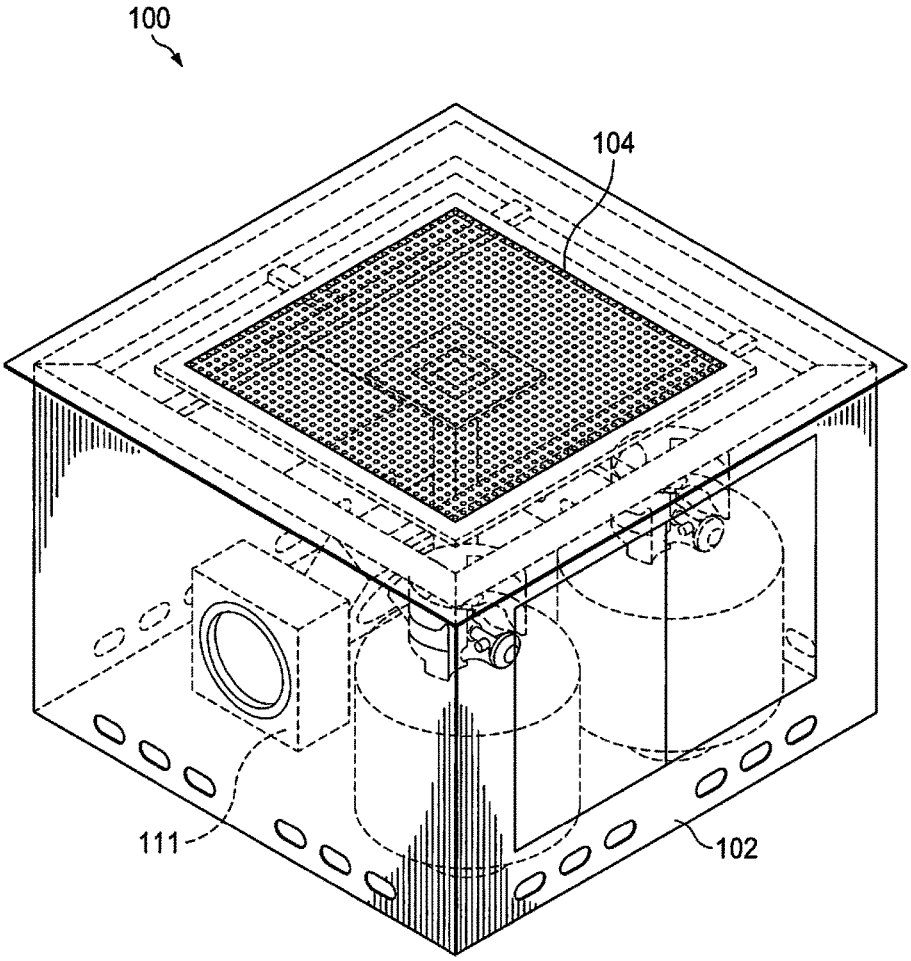
FIG. 5 is a transparent, perspective view of another embodiment of a fire pit insert assembly constructed in accordance with the inventive concepts disclosed herein.
Figure 6:
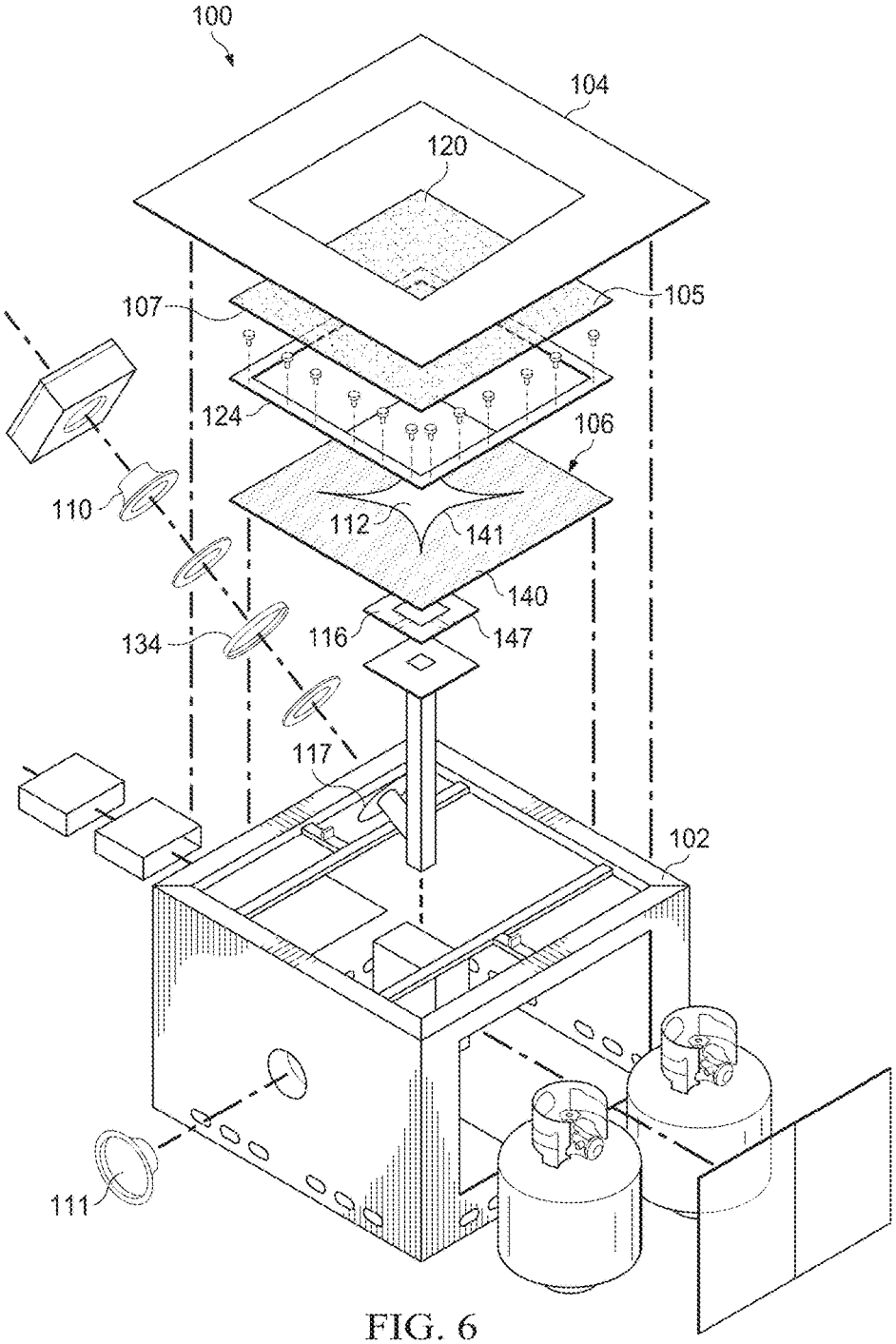
FIG. 6 is an exploded, perspective view of the fire pit insert assembly of FIG. 5.
Figure 7:
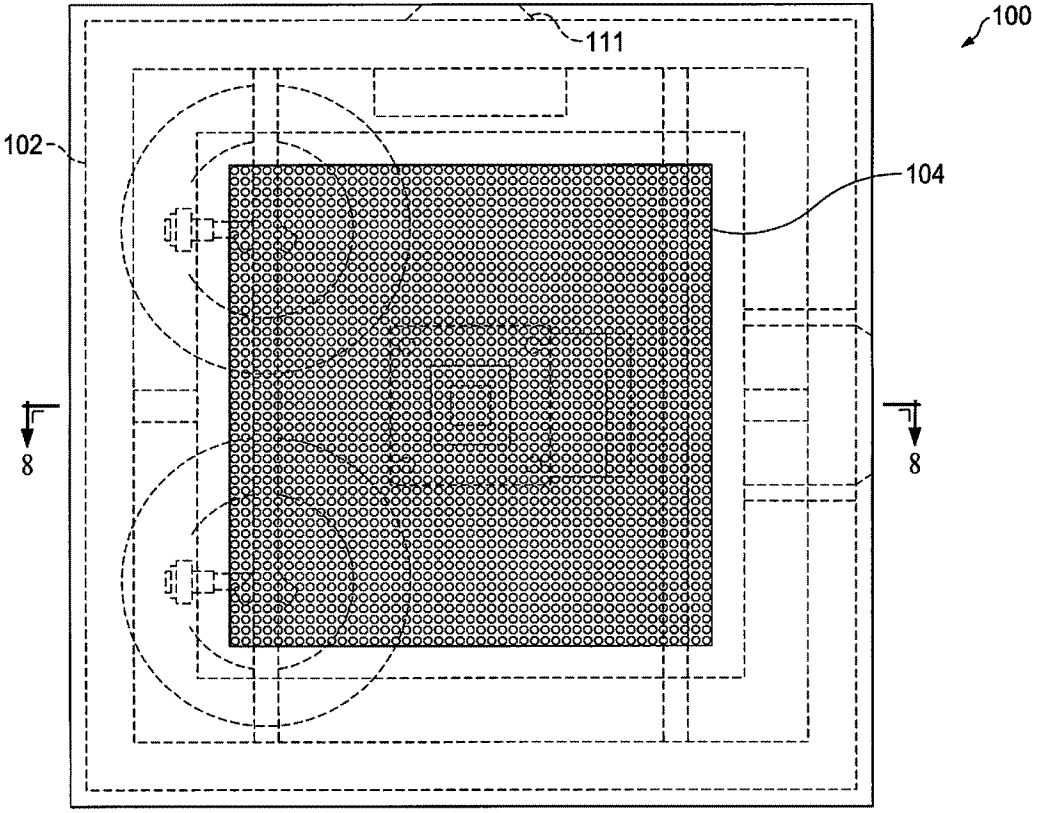
FIG. 7 is a top plan view of the fire pit insert assembly of FIG. 5.
Figure 8:
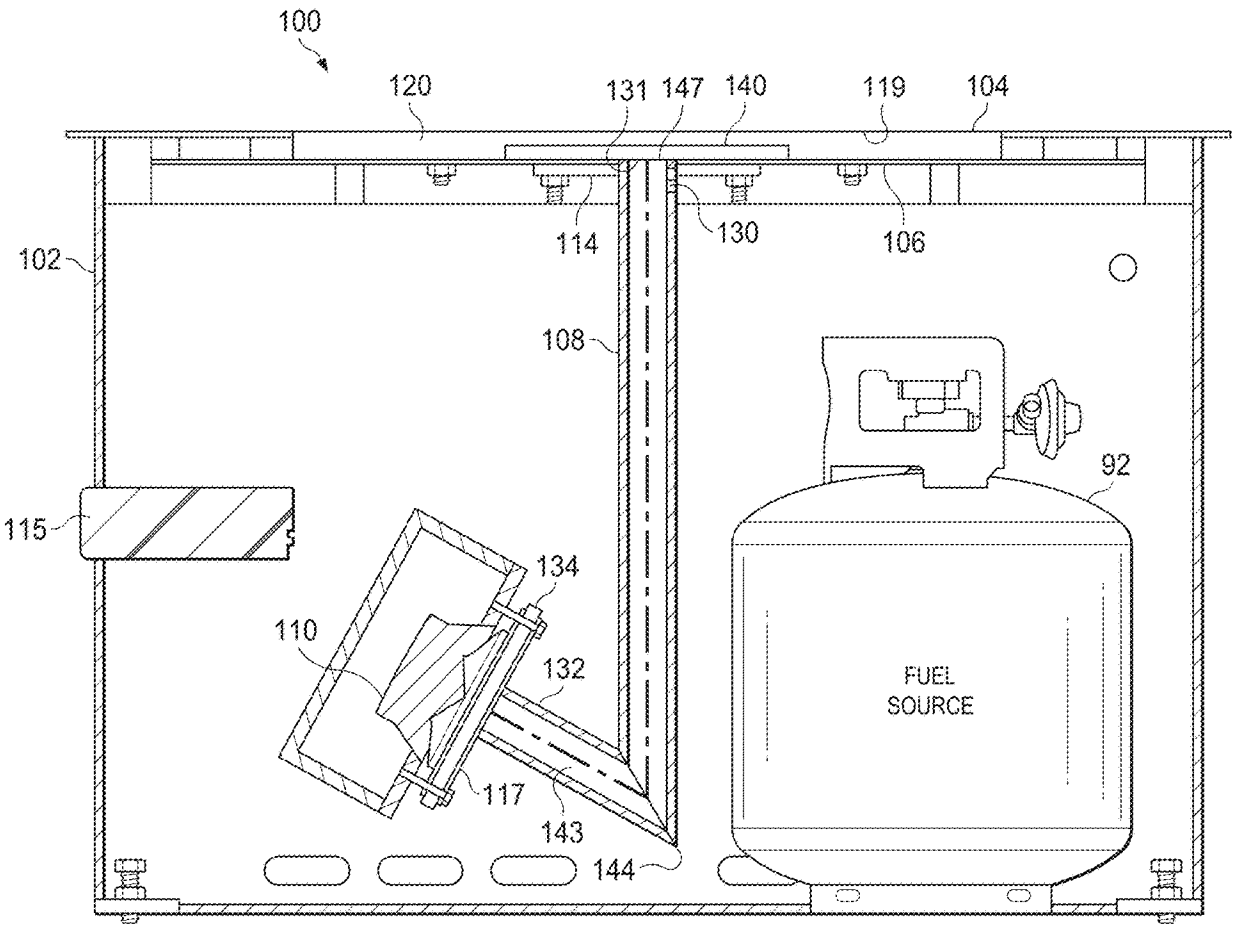
FIG. 8 is a sectional view taken along line 8-8 of FIG. 7.

FIG. 4 is a functional electrical block diagram of the patio gas fire pit insert with music interface 10. The speakers 75 are interconnected to the audio power amplifier 84 by two (2) sections of lower member. The signal carried could be stereophonic or monophonic. The audio signal from the wireless receiver 82 is carried by a low level signal wire 139 to the audio power amplifier 84. Electrical power to both the wireless receiver 82 and the audio power amplifier 84 is provided by AC power wiring 145 which is connected in a parallel path to the electrical cutoff switch 35 and ultimately to a local AC power source 150. Finally, the audio signal from the audio source 45 is wirelessly transmitted to the wireless receiver 82 by the wireless audio signal 50.

In one embodiment the device 10 can be utilized by the common user in a simple and effortless manner with little or no training. It is envisioned that the device 10 would be manufactured and constructed in general accordance with FIGS. 2-4. After fabrication, it would be installed in a fire pit 15 as shown in FIG. 1. Installation would also require hookup to a fuel source 92 as well as to a local AC power source 150. At this point in time, the device 10 is ready for operation.

Operation would begin by actuating the electrical cutoff switch 35 to supply electrical power to the wireless receiver 82 and the audio power amplifier 84. The user would then wirelessly connect the audio source 45 to the wireless receiver 82 and ensure the proper music is being played through the speakers 75. Next, the user would actuate the fuel cutoff valve 40 and establish a flow of flammable gas into the top surface 25 of the device 10. After an appropriate period of time, envisioned to be approximately ten (10) seconds, an ignition source such as a lighter or match would then ignite the flammable gas to enable flames on the top surface 25. At this point in time, the effect of flames "dancing" in coordination with the audio could be enjoyed.

When finished with use, the electrical cutoff switch 35 and the fuel cutoff valve 40 would be placed into an off or deactivated position to reset the device 10 for future use in a cyclical manner.

FIGS. 5-8 illustrate another embodiment of a fire pit insert assembly 100 constructed in accordance with the inventive concepts. The fire pit insert assembly 100 includes a housing 102, a top plate 104, a bottom plate 106, a mixing tube 108, a first speaker 110, and a second speaker 111. The bottom plate 106 is a generally planar member with a central opening 112 for receiving an upper end 147 of the mixing tube 108. The mixing tube 108 has a first end 131 and a second end 132. The first end 131 of the mixing tube 108 has a mounting plate 114 sealingly connected to the bottom plate 106 with a gasket 116 positioned between the mounting plate 114 and the bottom plate 106. The second end 132 of the mixing tube 108 has a mounting plate 117 for sealingly connecting the first speaker 110 to the mixing tube 108 in a way that the soundwaves generated by the first speaker 110 are directed into the mixing tube 108. A spacer 134 may be employed between the mounting plate 117 and the first speaker 110 to accommodate movement of the cone of the first speaker 110. The mixing tube 108 may include one bend 143 between the first and second ends 131, 132 and may be generally J-shaped to prevent liquid, such as rainwater from flowing down the mixing tube 108 and into the first speaker 110. The lowermost or bottom end 144 of the mixing tube 108 may be provided with a drain and drain plug (not shown).

Figure 9:
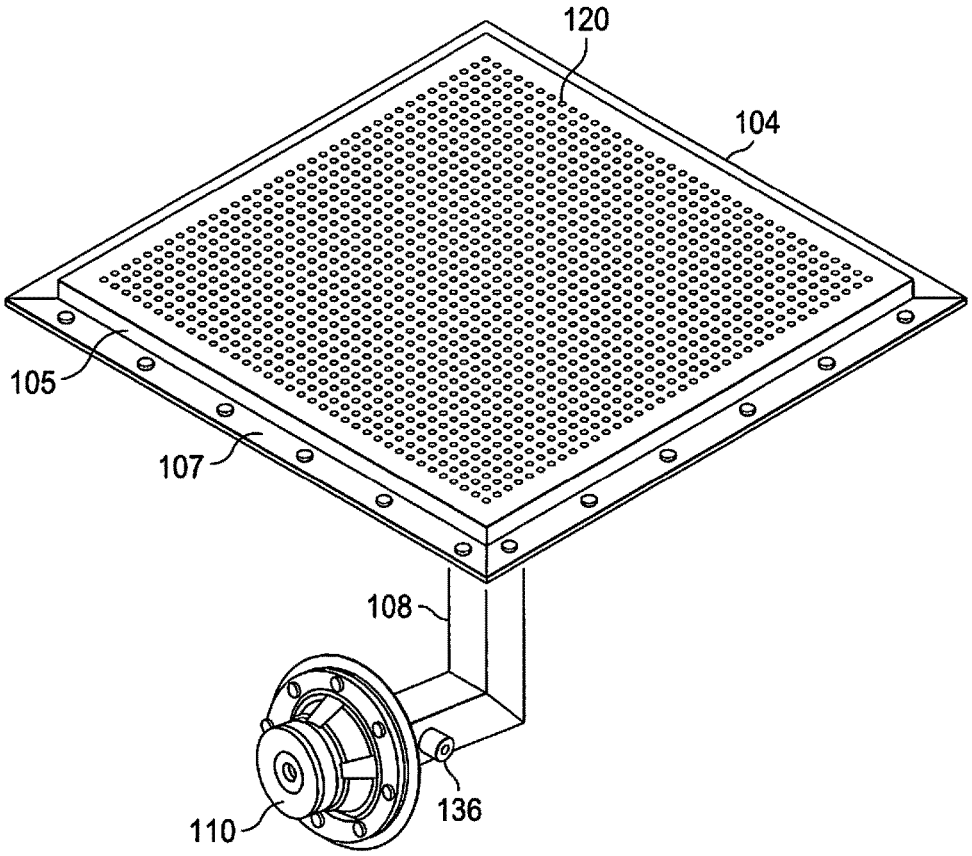
FIG. 9 is a perspective view of a portion of the fire pit insert assembly.

The mixing tube 108 includes a fuel inlet 136 (FIG. 9) positioned between the first (fuel outlet) end 131 and the second (soundwave inlet) end 132 thereof. In one embodiment, the fuel inlet 136 is positioned adjacent the second end 132 near the first speaker 110. The fuel inlet 136 can be any suitable coupling configured to receive a fuel source for the fire pit insert assembly 100. The fuel source may be provided by natural gas or propane, although other fuel sources could be utilized, and as such, the use of a specific fuel source should not be interpreted as a limiting factor of the inventive concepts disclosed herein. In one embodiment, the mixing tube 108 has a length such that the lower end of the mixing tube 108 is located in a lower end of the housing 102. In this way, the first speaker 110 is positioned away from the top plate 106 a sufficient distance to prevent damage to the first speaker 110 from the heat generated by the flame being emitted from the top plate 106. In addition, the flow of fuel through the mixing tube 108 functions to keep the heat from the flame from being transferred to the first speaker 110.

The top plate 104 is configured to cooperate with the bottom plate 106 to define a gas distribution space 119. In some embodiments, the top plate 104 has an inverted cake pan shape, with sidewalls 105, which may be sloping, and a lip 107. A gasket 124 is used to provide a gas tight seal between the top plate 104 and the bottom plate 106. The top plate 104 is provided with a plurality of orifices 120 from which flames are emitted. The overall size of the area of orifices may be approximately twenty inches by twenty inches in a generally square configuration. However, other shapes and sizes could also be utilized. In one embodiment, the orifices 120 may range in number from 1,500 to 2,000 and range in size from about 0.020 inches to about 0.060 inches.

A baffle plate 140 is positioned in the fuel or gas distribution space 119 in axial alignment and spaced relationship with the first end 131 of the mixing tube 108 in a way that gas flowing from the mixing tube 108 is directed evenly throughout the gas distribution space 119 and in turn through the orifices 120. The baffle plate 140 may be formed in a variety of shapes and sizes to distribute the flow of gas in a desired pattern. In one embodiment, the baffle plate 140 is a generally planar plate with four concave sides 141.

In one embodiment, the second speaker 111 is mounted in a side of the housing 102 and directed outwardly from the housing 102. While one outwardly directed speaker is shown mounted to the housing 102, it will be appreciated that a variety of speakers may be used to achieve a desired sound quality. The speakers 110 and 111 are connected to or in communication with a conventional source of audio signals, such as a radio, tape player, CD player, cellular telephone or the like, either wirelessly or directly. A communication center 115 mounted in the housing 102 may be used to house a receiver for receiving wireless audio signals, to house conventional audio components. The center 115 may also be used to house a controller for audio volume and a controller for gas volume.

The sound waves produced by the first speaker 110, such as music or voice, produce nodes and anti-nodes which travel through the mixing tube 108 and force the fuel gas through the mixing tube 108 and into the gas distribution space 119 The nodes and anti-nodes move the fuel as it passes through the orifices 120 in the top plate 104 producing the effect of resultant flames on the topside of the top plate 104 to move or "dance" according to the frequency of the waves (consisting of the nodes and anti-nodes) produced by the first speaker 110.

From the above description, it is clear that the inventive concepts disclosed and claimed herein are well adapted to carry out the objects and to attain the advantages mentioned herein, as well as those inherent in the disclosure. While embodiments have been described for purposes of this disclosure, it will be understood that numerous changes may be made which will readily suggest themselves to those skilled in the art and which are accomplished within the spirit of the inventive concepts disclosed herein.

What is claimed is:

1. A fire pit insert comprising:
a mixing tube including
a fuel outlet end at one end of the mixing tube,
a soundwave inlet end located at another end of the mixing tube below and horizontally offset from the fuel outlet end, and
a fuel inlet located between the fuel outlet end and the soundwave inlet end, the soundwave inlet being upstream of the fuel inlet; and
a fuel distribution chamber connected to the fuel outlet end of the mixing tube, the fuel distribution chamber including
a bottom plate,
a top plate with a plurality of orifices and sloping sidewalls extending in a downwardly outward direction toward the bottom plate,
the bottom plate spaced apart from the top plate by the sloping sidewalls,
a gasket located between the top and bottom plates and providing a gas tight seal between the top and bottom plates, and
a baffle arranged coaxial to the fuel outlet end.

2. A fire pit insert according to claim 1 further comprising a housing containing the mixing tube and the fuel distribution chamber.

3. A fire pit insert according to claim 2 further comprising at least one soundwave source connected to the soundwave inlet end and contained within the housing.

4. A fire pit insert according to claim 1 further comprising the fuel outlet end being located above and arranged coaxial to a lowermost end of the mixing tube.

5. A fire pit insert according to claim 4 further comprising the soundwave inlet end being located above the lowermost end of the mixing tube.

6. A fire pit assembly according to claim 1 further comprising the mixing tube including at least one bend between the fuel outlet end and the soundwave inlet end.

7. A fire pit insert according to claim 6 further comprising the bend including a lowermost end of the mixing tube.

8. A fire pit insert according to claim 1 further comprising the baffle including a planar plate.

9. A fire pit insert according to claim 8 further comprising the bottom plate including a concave-shaped central opening configured as the baffle.

10. A fire pit insert comprising:
a mixing tube including
a fuel outlet end,
a soundwave inlet end located below and horizontally offset from the fuel outlet end, and
a fuel inlet located between the fuel outlet end and the soundwave inlet end, the soundwave inlet end being located upstream of the fuel inlet; and
a fuel distribution chamber including
a bottom plate;
a top plate with a plurality of orifices and sloping sidewalls extending in a downwardly outward direction toward the bottom plate,
the bottom plate spaced apart from the top plate by the sloping sidewalls and connected to the fuel outlet end of the mixing tube, the bottom plate including a concave-shaped central opening coaxial to the fuel outlet end of the mixing tube, and
a gasket located between the top and bottom plates and providing a gas tight seal between the top and bottom plates.

11. A fire pit insert according to claim 10 further comprising the fuel distribution chamber including:
a baffle arranged coaxial to the fuel outlet end.

12. A fire pit insert according to claim 11 further comprising a housing containing the mixing tube and the fuel distribution chamber.

13. A fire pit insert according to claim 12 further comprising at least one soundwave source connected to the soundwave inlet end and contained within the housing.

14. A fire pit insert according to claim 10 further comprising the fuel outlet end being located above and arranged coaxial to a lowermost end of the mixing tube.

15. A fire pit insert according to claim 14 further comprising the soundwave inlet end being located above the lowermost end of the mixing tube.

16. A fire pit assembly according to claim 10 further comprising the mixing tube including at least one bend between the fuel outlet end and the soundwave inlet end.

17. A fire pit insert according to claim 16 further comprising the bend including a lowermost end of the mixing tube.

18. A fire pit insert according to claim 11 further comprising the concave-shaped central opening of the bottom plate configured as the baffle.

19. A mixing tube for a fire pit insert comprising:
a mixing tube including
a fuel outlet end located at an uppermost end of the mixing tube;
a soundwave inlet end located at another end of the mixing tube;
a fuel inlet located between the fuel outlet end and the soundwave inlet end and toward the soundwave inlet end, the soundwave inlet end being located upstream of the fuel inlet and the fuel outlet end being located downstream of the fuel inlet;
at least one bend located between the fuel outlet end and the soundwave inlet end, the bend including a lowermost end of the mixing tube;
a fuel distribution chamber including:
a bottom plate;
a top plate with a plurality of orifices and sloping sidewalls extending downwardly outward toward the bottom plate;
the bottom plate spaced apart from the top plate by the sloping sidewalls and connected to the fuel outlet end of the mixing tube, the bottom plate including a central opening located coaxial to the fuel outlet end of the mixing tube; and a gasket located between the top and bottom plates and providing a gas tight seal between the top and bottom plates.

20. A mixing tube according to claim 19 further comprising the central opening including concave-shaped sides.

* * * * *